US006448210B1

(12) United States Patent
Keyes et al.

(10) Patent No.: US 6,448,210 B1
(45) **Date of Patent: *Sep. 10, 2002**

(54) LIQUID AUTOMATIC DISHWASHING COMPOSITION WITH GLASSWARE PROTECTION

(75) Inventors: George B. Keyes, Racine; Charles E. Seaman, Kenosha; Jon K. Kasson, Racine, all of WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/504,360

(22) Filed: Feb. 15, 2000

Related U.S. Application Data

(63) Continuation-in-part of application No. 09/272,133, filed on Mar. 19, 1999, now Pat. No. 6,083,894.

(51) Int. Cl.[7] ..... C11D 7/06; C11D 7/10

(52) U.S. Cl. ..... 510/221; 510/223; 510/227; 510/229; 510/405; 510/434

(58) Field of Search ..... 510/221, 223, 510/227, 229, 405, 434

(56) References Cited

U.S. PATENT DOCUMENTS

| | | | | |
|---|---|---|---|---|
| 2,575,576 A | | 11/1951 | Bacon et al. | 252/138 |
| 2,701,811 A | | 2/1955 | Chester | 260/429 |
| 3,255,117 A | | 6/1966 | Knapp et al. | 252/99 |
| 3,350,318 A | | 10/1967 | Green | 252/135 |
| 3,907,640 A | | 9/1975 | Gillenwater | 195/36 |
| 4,001,133 A | * | 1/1977 | Sorgenfrei et al. | 252/156 |
| 4,017,410 A | | 4/1977 | Sorgenfrei et al. | 252/156 |
| 4,416,794 A | | 11/1983 | Barrat et al. | 510/514 |
| 4,443,270 A | | 4/1984 | Biard et al. | 134/25.2 |
| 4,601,844 A | | 7/1986 | Cilley | 510/228 |
| 4,714,562 A | | 12/1987 | Roselle et al. | 510/221 |
| 4,917,812 A | | 4/1990 | Cilley | 510/227 |
| 4,933,101 A | | 6/1990 | Cilley et al. | 510/222 |
| 5,545,344 A | | 8/1996 | Durbut et al. | 510/223 |
| 5,783,544 A | | 7/1998 | Trinh et al. | 510/293 |
| 6,083,894 A | * | 7/2000 | Keyes et al. | 510/221 |

FOREIGN PATENT DOCUMENTS

| | | | |
|---|---|---|---|
| EP | 0 109 279 | 11/1983 | C11D/3/48 |
| EP | 0 254 486 | 1/1988 | C07C/59/105 |
| EP | 0 387 997 | 2/1990 | C11D/3/395 |
| GB | 1 443 570 | 9/1973 | C11D/7/60 |

OTHER PUBLICATIONS

Database WPI Derwent Publications Ltd., London GB; AN 1995 070581 XP002141590 & JP 06 346099A (Teepol KK) Dec. 20, 1994, Abstract.

* cited by examiner

*Primary Examiner*—Yogendra N. Gupta
*Assistant Examiner*—Brian P. Mruk
(74) *Attorney, Agent, or Firm*—Neil E. Hamilton; Warren R. Bovee; Renee J. Rymarz

(57) ABSTRACT

A liquid dishwashing detergent composition having improved glassware protection when employed in conjunction with cleaning materials having high concentrations of alkaline materials. The composition contains a soluble organic zinc compound which preferably is zinc gluconate and is particularly suited to fast cycle commercial (I&I) dishwashers. The zinc gluconate is prepared in situ or zinc and gluconic ions are provided in a batching process.

7 Claims, 2 Drawing Sheets

GRAPH A

GRAPH B

CORROSION OF (.1%) DETERGENT CONCENTRATION OF FORMULA EXAMPLES #5 AND #6 AND FORMULA JK 0189 W009 A (CONTROL) ON GLASS IN VARIOUS PPM OF WATER HARDNESS

LIQUID AUTOMATIC DISHWASHING COMPOSITION WITH GLASSWARE PROTECTION

CROSS-REFERENCE TO RELATED APPLICATIONS

This is a continuation-in-part of Ser. No. 09/272,133, filed Mar. 19, 1999 now U.S. Pat. No 6,083,894

STATEMENT REGARDING FEDERALLY SPONSORED RESEARCH OR DEVELOPMENT

NONE

BACKGROUND OF THE INVENTION

1. Technical Field

This invention relates to compositions for cleaning glassware. More particularly, it relates to glassware cleaning compositions for use in automatic dishwashing machines of the Industrial and Institutional (I&I) type wherein the compositions afford glassware protection.

2. Background Art

Compositions for use in dishwashing wherein the compositions afford glassware protection are well known. These are described in U.S. Pat. Nos. 2,575,576; 3,255,117; 3,350,318; 4,416,794 and 4,443,270 which teach the use of soluble zinc salts for this purpose. In U.S. Pat. No. 2,575,576 a water soluble zinc salt is employed to prevent the corrosion of vitreous and ceramic surfaces. In U.S. Pat. Nos. 3,255,117 and 3,350,318 soluble zinc salts are described for use in automatic dishwashing detergent compositions. In U.S. Pat. No. 3,677,820 it is taught that solid plates of zinc metal alloys are placed in contact with the use concentration of the detergent composition where the metal zinc slowly dissolves, and thereby needs occasional replacement to provide corrosion protection to glassware. A soluble zinc salt is disclosed in U.S. Pat. No. 4,443,270 in conjunction with a low foaming nonionic surfactant and in U.S. Pat. No. 4,416,794 zinc salts of chloride, sulfate or acetate are taught.

In U.S. Pat. Nos. 4,908,148 and 4,933,101 insoluble inorganic zinc compounds are employed in conjunction with a surfactant. However, relatively large amounts of the insoluble inorganic zinc compounds are required. Further, the inorganic compounds are suspended in the form of highly viscous liquids or slurries which present problems as further explained herein.

SUMMARY OF THE INVENTION

Notwithstanding the teachings of the prior art, there is a need for an improved liquid automatic dishwashing composition which can provide efficient cleaning in fast cycle I&I dishwashing machines yet provide glassware protection.

Accordingly, the advantages of the invention are:

a. Providing an improved dishwashing composition.

b. Providing an improved dishwashing composition for use with fast cycle I&I dishwashing machines which have previously required highly corrosive alkaline materials.

c. Providing an improved dishwashing composition of the foregoing kind which utilize minimal amounts of zinc salts.

d. Providing an improved method of utilizing the foregoing kind wherein the zinc salt is low in toxicity.

e. Providing an improved method of utilizing the foregoing composition.

The foregoing advantages are accomplished by the dishwashing composition of this invention which includes in one embodiment a chelate, an alkaline producing material, and a soluble zinc organic salt.

In another embodiment, the zinc salt is zinc gluconate, zinc formate or zinc acetate.

In a preferred embodiment, the zinc salt is zinc gluconate.

In still another preferred embodiment the liquid automatic dishwashing detergent composition includes from 15% to about 75% of a chelate, from about 5% to about 25% of an alkaline producing material and from about 2% to about 10% of a soluble zinc organic salt.

In yet another preferred embodiment the chelate is present in an amount of about 30% to about 70%, the alkaline producing material is present in an amount of about 7% to about 15%, and the zinc organic salt is present in an amount of about 3% to about 5%.

In still another preferred embodiment the chelate includes an organic phosphonate polymer.

In one aspect a method of washing glassware is provided employing the composition of this invention and in a preferred manner in conjunction with a rinsing agent having a nonionic surfactant.

In another aspect the zinc gluconate is formed in an in situ process step.

In yet another aspect zinc and gluconate ions are provided in the dishwashing detergent composition by zinc and gluconate salts.

Further aspects and advantages of the invention will become apparent from the description of the preferred embodiments which follows:

DESCRIPTION OF PREFERRED EMBODIMENTS

Figure 1:
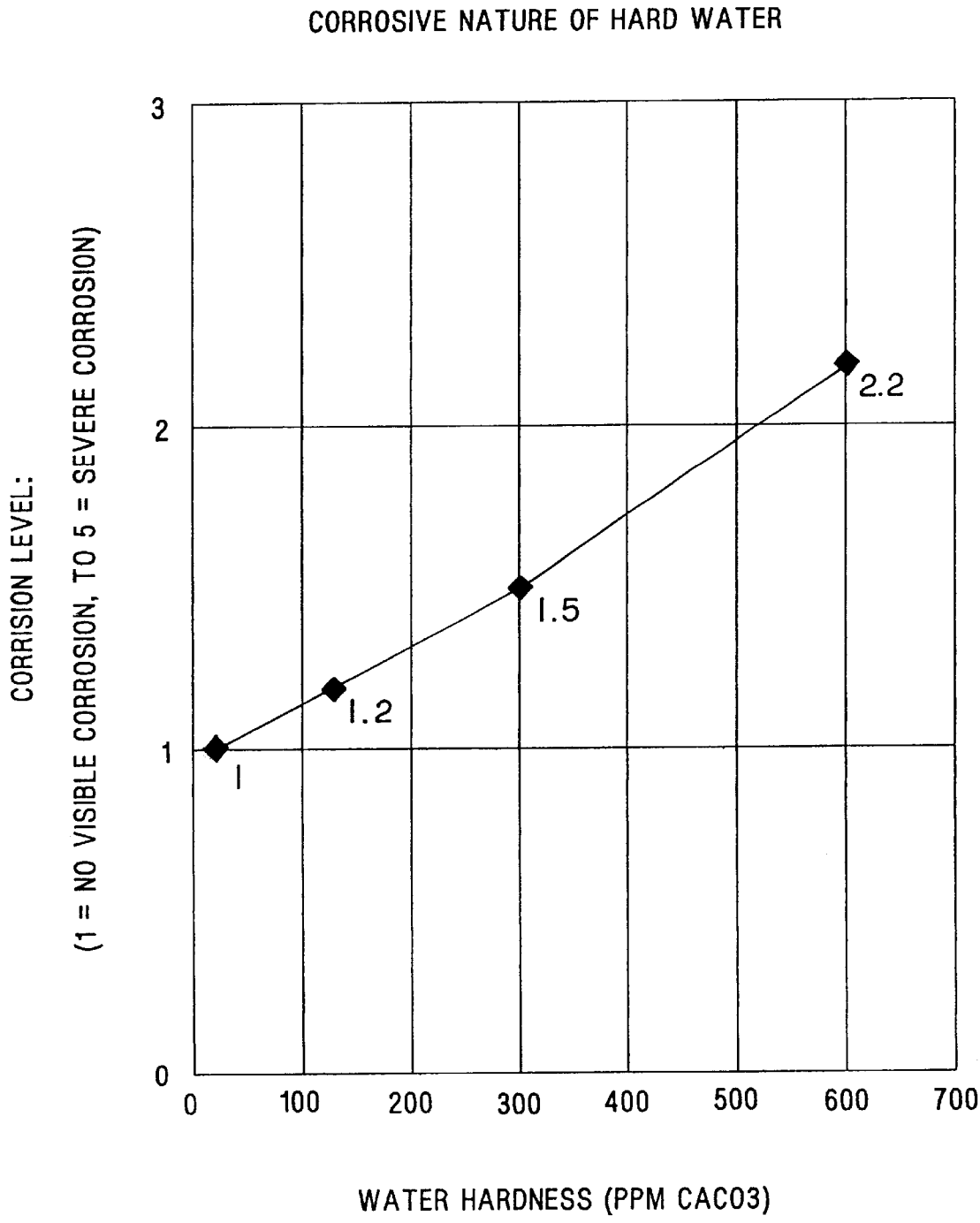
FIGS. 1 and 2 are graphs showing certain comparative test results.

It has been found with the formulations of this invention that by adding as little as 3 to 6.4 ppm zinc, in the form of a water soluble organic salt, into a 0.10% use concentration of a liquid I&I warewash formulation, a measurable reduction of corrosion to glass can be achieved when comparing to an identical formula without the zinc component. (See FIG. 2). This is of economic importance to restaurant or pub owners because of the savings derived by extending the use life of their current glassware regardless of the hardness of the local water. The primary application for these liquid concentrates is anywhere glasses are subjected to repeated washings in automatic I&I cleaning machines (i.e., dishwashers). It is important to understand a major difference between I&I dishwashers and consumer designed dishwashers; dishwashers for the consumer market (household sized) typically take from 8 to 20 minutes to execute one complete cleaning, rinsing and sanitizing cycle, while I&I dishwashers will complete the cycle within from 45 seconds to 75 seconds. This reduced cycle timing is accomplished in part by using highly alkaline raw materials such as sodium and potassium hydroxide, which are corrosive to glass surfaces. Reduced corrosion employing the composition of this invention could also be extended for use in liquid manual dishwashing concentrates.

This discovery of obtaining reduced corrosion on glass using extremely low concentrations of water soluble forms of organic zinc salts differs in many ways from those described in the previously referred to U.S. Pat. Nos. 4,933,101 and 4,908,148. The soluble zinc concentration of this invention can be less than 10 times the minimum concentration cited in the reference patents and still provide a measurable reduction in glass corrosion. It has been found that liquid warewash detergents using water soluble organic salts to provide an elemental zinc concentration as low as 0.00032% (3.2 ppm) in the final use dilution can be shown to reduce corrosion to glass. In the referenced prior art patents insoluble inorganic zinc compounds are employed at a final zinc level of 0.01% (100 ppm).

Because the composition of this invention provides the zinc in a water soluble form, the zinc is evenly distributed throughout the concentrate and thus, when pumped, or metered, into I&I type dishwashers, a uniformly dissolved concentration of zinc is provided to maintain the benefit of reduced corrosion to glass. Small conventional pumps are not typically adequate to pump highly viscous liquids or slurries as those described in the referenced patents. In fact, formulas of the referenced patents are most likely intended for the consumer retail market where a homeowner would squeeze or pour the slurry manually out of a bottle.

As a stable water soluble organic salt, the zinc salt of this formulation is much more readily available to provide protection to the surface of glass from alkali corrosion than is a solid, or colloidal form of zinc. In the soluble form, the zinc salt of this composition is more uniformly and efficiently dispersed in solution because it is present essentially on an elemental level as compared to a much larger insoluble solid form or particle. In essence, a liquid is a more efficient delivery system freely moving soluble zinc to or around the glass surface.

Another disadvantage of formulas of the referenced '101 and '148 patents is that they contain granular phosphates in one form or another and as such, a reaction with zinc will produce zinc phosphate, a compound that is insoluble in water. This is indicated at page 1036 of The Condensed Chemical Dictionary (1961). This reinforces the reason why the formulations taught in these referenced patents must contain 10 to 20 times, at a minimum, more inorganic zinc material to achieve glass corrosion reduction or protection. In contrast, the formulations of this invention do not use any inorganic phosphates. Using an insoluble form of zinc requires a much larger quantity of material to provide a measurable reduction in glass corrosion, because less usable zinc is directly available off the surface of the insoluble particle, or present at the glass surface, than with a stable solubilized zinc system. In solution, the zinc of this invention is 100% uniformly dispersed throughout the liquid and zinc therein is instantly available to provide protection against glass corrosion, whatever the mechanism, than is an insoluble solid dispersed in a slurry.

Additionally, the zinc in the form of a water-soluble material will not settle out of solution on standing or shipping, which is a normal handling concern for a product of this type. However, when trying to uniformly disperse and immobilize a small insoluble particulate into a liquid, and it is desired to maintain that condition, this is generally accomplished by adding in thickeners which help to slow the natural effect of gravity which wants to have the insoluble solid settle out on the bottom of any container. The formulations of this invention avoid this disadvantage by finding and using soluble organic zinc salts in the most preferred formulations.

When formulating any cleaning concentrate, a consideration must be given to the toxicity of any new chemical that might be added to a particular formulation. It has been shown that by adding a recognized food additive ingredient to the formulations of this invention and using it as a functional ingredient a reduction in glass corrosion can be demonstrated as well as avoiding the addition of a toxic material which affects the toxicity profile of the product. Environmentally, the levels of soluble zinc that would be found in waste water exiting the cleaning equipment are well below the minimum limits that are currently set in existing waste water regulations (25 ppm zinc). This preferred new material of choice, which is listed on the FDA's "GRAS" list, is zinc gluconate. Also this novel inclusion of this material into warewash formulations does not significantly change the cleaning ability of use dilutions when compared to similar solutions that do not contain any water soluble zinc compounds, however, it does provide a measurable reduction to glass corrosion when it is present. The zinc gluconate is most preferred, however we have found that similarly low concentrations of zinc formate, and zinc acetate also work well.

It is believed that the most cost effective concentrations of water-soluble organic zinc salts in the formulations of this discovery will be in the range from 1.0 to 10.0%, which correlates to use-dilutions concentrations of 0.10% to 1.0% when diluted 1:1000. Thus if the preferred zinc gluconate containing formula uses a 5.0% level, then on dilution at a 1:1000 ratio the calculated amount of soluble elemental zinc in solution would be:

(5.0%Zn G)(0.1% conc.)(% Zinc G in raw material)(%Zinc in Zinc Gluconate) or (5.0)(0.001)(0.894)(0.1435)=0.00064% or 6.4 ppm zinc.

The most preferred formulations of this discovery use water soluble organic zinc salts to reduce corrosion to glass and provide this wanted feature even in the presence of highly alkaline solutions of sodium and potassium hydroxides, or regardless of the chelate used (e.g., EDTA, NTA, organic polymeric materials typically used in I&I warewash applications, etc.) to control the effects of hard waters. It is noteworthy that this heavy metal salt remains in solution in the concentrate and the solution remains long term storage stable while it maintains its corrosion protection capability while in the presence of chelates that are designed to sequester heavy metals to inhibit precipitation as calcium and magnesium carbonates, soluble iron, etc., which may deposit on glassware creating an unacceptable appearance problem.

While not understanding the mechanism, it is appreciated that the water soluble zinc salt continues to provide the glass corrosion protection property in the presence of an overwhelming concentration of the chelating material. The complex formed between the chelate and the water soluble zinc salt does not inhibit the glass protection property from being extended to the glass.

Further understanding of the compositions of the invention will be understood with reference to the following Examples wherein all parts and percentages are by weight unless otherwise specified. These Examples are set forth to illustrate the invention and are not intended to limit the invention in any way.

TABLE 1

| Material | Ex 1 | Ex 2 | Ex 3 | Ex 4 | % Ranges preferred | % Ranges most preferred |
|---|---|---|---|---|---|---|
| Water | 17.20 | 18.50 | 18.00 | 17.05 | 15.00–20.00 | 17.00–19.00 |
| Trisodium Salt of NTA (40%) | 68.50 | 68.50 | 68.50 | 68.50 | 60.00–75.00 | 65.00–70.00 |
| Sodium Hydroxide (100%) | 4.00 | 4.00 | 4.00 | 4.00 | 2.00–7.00 | 3.00–5.00 |
| Potassium Hydroxide (90%) | 5.00 | 5.00 | 5.00 | 5.00 | 3.00–8.00 | 4.00–6.00 |
| Dequest 2010* | 0.3 | 1.00 | 1.50 | 0.30 | 0.10–3.00 | 0.30–1.50 |
| Zinc gluconate | 5.00 | 3.00 | 3.00 | 5.00 | 2.00–10.00 | 3.00–5.00 |
| FD&C Yellow #5 (1% solution) | Trace | Trace | Trace | 0.15 | 0.001–0.30 | 0.10–0.20 |

| Material | Ex 5 | Ex 6 | % Ranges preferred | % Ranges most preferred |
|---|---|---|---|---|
| Water | 16.50 | 17.50 | 15.00–20.00 | 17.00–19.00 |
| Trisodium Salt of NTA (40%) | 68.50 | 68.50 | 60.00–75.00 | 65.00–70.00 |
| Sodium Hydroxide (100%) | 5.00 | 4.00 | 2.00–7.00 | 3.00–5.00 |
| Potassium Hydroxide (90%) | 4.00 | 5.0 | 3.00–8.00 | 4.00–6.00 |
| Dequest 2010* | 1.0 | 1.00 | 0.10–3.00 | 0.30–1.50 |
| Zinc gluconate | 5.00 | 3.00 | 2.00–10.00 | 3.00–5.00 |
| FD&C Yellow #5 (1% solution) | Trace | Trace | 0.001–0.30 | 0.10–0.20 |

*SOLUTIA INC. ST. LOUIS, MO

TABLE 2

| Material | Ex 7 | Ex 8 | Ex 9 | % Ranges preferred | % Ranges most preferred |
|---|---|---|---|---|---|
| Water | 14.45 | 43.70 | 49.20 | 10.00–60.00 | 40.00–50.00 |
| Tetrasodium Salt of EDTA (40%) | 70.00 | 42.00 | N/A | 30.00–75.00 | 45.00–70.00 |
| Trisodium Salt of NTA (40%) | N/A | N/A | 30.50 | 20.00–50.00 | 30.00–40.00 |
| Sodium Hydroxide (100%) | 4.80 | 9.00 | 10.00 | 3.00–15.00 | 5.00–10.00 |
| Potassium Hydroxide (90%) | 4.25 | N/A | 5.00 | 3.00–10.00 | 3.00–6.00 |
| Dequest 2010* | 1.50 | 0.30 | 0.30 | 0.10–3.00 | 0.30–1.50 |
| Zinc gluconate | 5.00 | 5.00 | 5.00 | 2.00–10.00 | 3.00–5.00 |
| Dye (1% solution) | Trace | Trace | Trace | Trace | Trace |

The materials of these Examples are added in the descending order indicated to stainless steel tanks having a propeller mixer. The water should be added first and the dye last. The ingredients are mixed until solubilized at a temperature in the range of 72–77° F. Precautions should be taken when the hydroxide materials are added due to the exothermic heat of solution that will be generated.

Dequest 2010 is an organic phosphate polymer and is a preferred chelating agent. However, other polymeric chelating agents could be employed such as Dequest 2000, Dequest 3000S, Bayhibt AM (Albright & Wilson) Acusol 445 N (Rohm and Haas Company), Accusol 448 (Rohm and Haas Company) and Acumer 2000 (Rohm and Haas Company).

Figure 2:
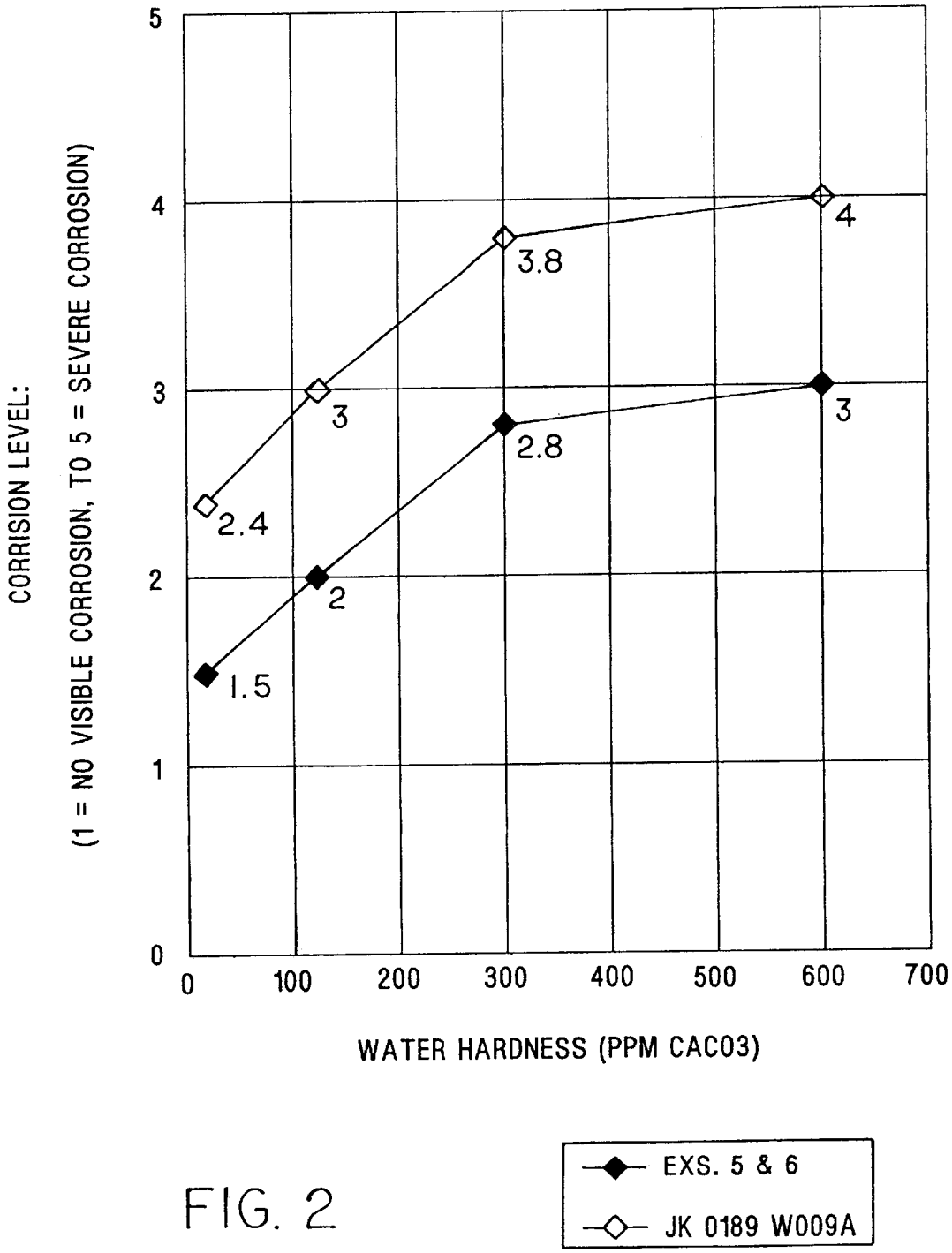

While zinc gluconate is the preferred organic zinc compound as indicated earlier, others can be employed such as zinc formate and zinc acetate. For the formulas of Examples 5 and 6 it was confirmed that 5% zinc gluconate was a reasonable level to incorporate into the base formula concentrate. At a 0.1% use concentration (containing the 5% level of zinc gluconate) it has been observed that a significant reduction of corrosion to glass slides occurs when compared to identical formulations without the zinc gluconate added. FIG. 2 compares the corrosion reduction property of formula Example No. 5 containing zinc gluconate to the higher corroding formula without zinc gluconate (JK 0189 W009). The elemental level of zinc in solution at this use-concentration is approximately 6.4 ppm, indicating that the test method is sensitive and reliable to determine the effect on glass surface chemistry with this low of a concentration of the functional ingredient. Glass corrosion at formula use concentrations below 0.1% (e.g., 0.01% and 0.05%), even in 300 ppm hard water, because of the low level of actives, starts to approach the corrosion profile of hard water, so it is recommended that a use concentration of 0.1% be the minimum dilution considered. Secondarily, it is expected that the cleaning performance of use dilutions below 0.1% will dramatically fall off when comparing cleaning performance of 0.1% use dilutions of Formula JK 0189W009 A which was used as the target benchmark.

Test Results

Using the formula Examples 5 and 6 as base formula the level of zinc gluconate was altered from levels of 5% to 3%, 1% and 0.5% and tested for effect on glass corrosion at the formula use-concentration of 0.1%, diluting with 300 ppm hard water. Significant reduction in the level of corrosion was observed as long as the zinc gluconate concentration was at or above 3%. Below 3% (3.8 ppm elemental zinc in solution), a trend in overall improvement in reduced corrosion was still observed, but the level is low and the variability of the improvement (reduction of corrosion) large. See Table A below.

TEST A - 24 HOUR TEST DATA*

| FORMULA | % ZINC GLUCONATE | AVE. CORROSION SCORE | % REDUCED CORROSION |
|---|---|---|---|
| Ex. 5 and 6 | | | |
| | 5.0 | 3.1 | 31.1 |
| | 3.0 | 3.5 | 22.2 |
| | 1.0 | 4.4 | 2.2 |
| | 0.5 | 4.4 | 2.2 |
| Formula JK 0189 W009 A | 0.0 | 4.5 | — |

*(3 separate tests, 5 test slides per formula variation)

The product of Examples 5 and 6 was prepared, using 300 ppm hard water, at use-concentrations of from 0.1% to 1.0% in 0.1%, or 0.2% increments and tested for corrosion differences. Again, Formula JK 0189 W009 A was used as the control formula. The improvements in reduced glass corrosion leveled off once the Example 5 and 6 formula concentration approached or exceeded 0.3–0.4%. The observed corrosion level of the Formula JK 0189 W009 A formula was higher than any of the Example 5 and 6 use-concentrations.

After preparing a JK 0189 W009A formula (with five percent of the water removed) the batch was split in half; zinc gluconate was added at a 5% level to one half and water at a 5% level to the other half. In this manner all other ingredients for each of the two variations remained the same. Using dilutions of these concentrates, corrosion tests were conducted on laboratory glass slides and on 9 oz Hi-ball glasses. For both types of glass tested, water conditions of about 10 ppm (Deionized water) and 300 ppm hard water were used. These tests were run to see if the reduced corrosion effect seen in testing with laboratory slides would continue into actual food service drinking glasses. The following Tables B & C show the results.

TEST B--CORROSION TEST USING BASE FORMULA

| | CORROSION SCORE | | % REDUCTION | |
|---|---|---|---|---|
| FORMULA (0.1%) | Slides | Glasses | Slides | Glass |
| Formula JK 0189 W009 A | | | | |
| Deionized Water | 3.0 | 2.0 | — | — |
| 300 ppm Hard Water | 4.0 | 4.6 | — | — |
| Ex. 5 and 6 | | | | |
| Deionized Water | 2.4 | 2.0 | 20 | 0.0 |
| 300 ppm Hard Water | 2.6 | 3.0 | 35 | 34.8 |

TEST C--CORROSION TEST USING BASE FORMULA

| | CORROSION SCORE | | % REDUCTION | |
|---|---|---|---|---|
| FORMULA (0.1%) | Slides | Glasses | Slides | Glass |
| Formula JK 0189 W009 A | | | | |
| Deionized Water | 1.8 | 2.6 | — | — |
| 300 ppm Hard Water | 3.4 | 4.4 | — | — |

-continued

TEST C--CORROSION TEST USING BASE FORMULA

| | CORROSION SCORE | | % REDUCTION | |
|---|---|---|---|---|
| FORMULA (0.1%) | Slides | Glasses | Slides | Glass |
| Ex. 5 and 6 | | | | |
| Deionized Water | 1.4 | 2.0 | 22.2 | 23.1 |
| 300 ppm Hard Water | 1.8 | 3.8 | 47.1 | 13.6 |

As can be seen, the level of corrosion (scores) to glass is more subtle with dilutions using deionized (soft) water than it is for the hard water. Part of the explanation for this is that soft water is not as aggressive towards glass as the hard water. This is demonstrated in FIG. 1 as Graph A. The addition of product to either water type increases the alkalinity of aqueous solutions which increases its potential corrosivity; one would then expect a hard water dilution of product to be more corrosive than a dilution made with deionized (soft) water, and this is the situation in every comparison of Test B and Test C data. Thus, the corrosion trend seen in FIG. 1, Graph A is repeated with product dilutions using water of different hardness, regardless of whether one is looking at glass slide or drinking glass data.

Percentage-wise, the average reduction in corrosion from Test B and Test C, for both slides and glasses when the product of Examples 5 and 6 was diluted with deionized water, was 16.3%. when diluted with 300 ppm hard water, the average reduction was 32.6%. For glasses alone, the average percent reduction of both sets of tests was 24.3%. Cleaning tests were also run to compare Formula JK 0189 W 009A and its zinc gluconate counterpart—Examples 5 and 6 product to another warewash formula, Formula JK 0189 W009 B (containing twice the alkalinity as the other two formulas). Two sets of tests were run using an automatic high-temperature HOBART dishwasher. Each formula was tested at 0.1% and 0.25% concentrations and prepared by diluting with local tap water (~125 ppm hardness) and run against 7–10 soiled plates (using a Beef Stew/Rice soil) in each test. The averaged results of both tests are as follows:

TEST D - CLEANING RESULTS FROM DISHWASHER

| FORMULA | AVERAGE % SOIL REMOVED | | |
|---|---|---|---|
| CONC. | JK 0189 W009 A | Ex. 5 and 6 | JK 0189 W009 B |
| 0.1% | 89.6 | 87.4 | 90.0 |
| 0.25% | 93.4 | 88.1 | 89.3 |

In that JK 0189 W009 A and Example 5 and 6 products are the same exact formula except for the addition of zinc gluconate, it would appear that the cleaning is essentially comparable. Consideration should be given to the fact that when using automated dishwashing equipment most of the cleaning is achieved via the jetted hot water spraying against the plates; tap water cleaning of the same above soiled test plates only removed 80.09% of the soil. It should also be recognized that in this laboratory test, soil was developed so that it not would be 100% removed by one cleaning; the difficulty of its removal provides the way to measure between detergents which are more inclined to remove real world soils. If the test soil were 100% removed from the test plates then improvements to formula variation would be impossible to detect.

Identically soiled test plates, as used in Test D above, were evaluated using a "DIP" method which used the same soil as mentioned above. The soiled plates are briefly immersed (dipped) into use concentrations, and rinsed off. The percent soil removed is determined by weighing the dried soiled test plates before and after cleaning. The percent soil removed is much less than the previous test, but the mechanical advantage of jetting hot water is removed in this test and what is being observed is how much the soil can be wetted, penetrated, softened and removed with a gentle rinse upon removal from the soak solution. The data below reflects the averaged results of three separate tests:

TEST E - DIP METHOD CLEANING RESULTS

| FORMULA (% CONC.) | % SOIL REMOVED |
|---|---|
| Ex. 5 and 6 (0.1% in 300 ppm hard water) | 16.9 |
| Ex. 5 and 6 (0.1% in 300 ppm hard water) | 16.6 |
| JK 0189 W009 A (0.1% in 300 ppm hard water) | 18.0 |
| JK 0189 W009 B (0.1% in 300 ppm hard water) | 25.0 |
| Control 300 ppm hard water | 15.3 |
| Deionized water alone | 15.5 |

Again, the cleaning performance of the Example 5 and 6 formulas is statistically comparable to the JK 019 W009 A results, however it appears from this data, and that in Test E above, that there may be a very slight drop in cleaning ability as the reduction corrosivity to glass is improved. Given the cleaning dynamics of automatic dishwashers using water alone, it is felt that real world users of Example 5 and 6 formula would never observe this small potential cleaning difference. However, it is expected that users will observe the reduction in corrosion to glass and see it as a "product plus" that in effect will extend the use life of their glassware.

In Examples 1–9 zinc gluconate is employed as a compound initially in the batching process in combination with the additional indicated materials. If desired, the zinc gluconate could be formed in situ or zinc and gluconate ions provided in the batching process according to the teachings of the following Examples 10 and 11.

EXAMPLE 10

| MATERIAL | % wt. |
|---|---|
| Deionized Water | 17.88% |
| Gluconic Acid | 2.58% |
| Zinc Oxide Powder, (~1 micron) | 0.54% |
| Trisodium Salt of NTA (40%) | 68.50% |
| Dequest 2010 | 1.50% |
| Potassium Hydroxide, Flake (90%) | 5.00% |
| Sodium Hydroxide, Anhydrous | 4.00% |
| | 100.00% |

The materials are added to a suitable reaction vessel in a descending order of listing. The Deionized water, Gluconic acid and NTA are combined in a batching vessel and stirred at a moderate speed. The NTA is added to increase the volume of the batch, which increases the mixing capabilities in the batching vessel. The Zinc oxide powder is slowly added to the surface of the mixture, with care being taken to avoid any clumping of the powder. Heat is applied to bring the temperature of the solution to 140° F. (60° C.). The Dequest 2010 is added to the solution and the temperature maintained with stirring until the solution clears. It is important that the heat be maintained until the solution clears and all particles of the Zinc oxide powder have dissolved into solution.

As soon as it is certain that Zinc oxide has reacted completely with the Gluconic acid to form zinc gluconate and the solution has cleared, the heat is removed and cooling is applied to the batching vessel. Upon the addition of the caustics, cooling will be necessary due to the exothermic alkali heat of solution. The solution may cloud slightly on addition of the caustics, but with continued mixing it will clear after several minutes.

This method will work with any of the NTA or EDTA based detergents in conjunction with Zinc gluconate. It is important that the 140° F. (60° C.) temperature is reached, to allow complete reaction of Gluconic acid and Zinc oxide to Zinc gluconate. If the reaction is not complete, i.e., the solution has not cleared or granular Zinc oxide is present in solution, the addition of the Sodium hydroxide may react with the Gluconic acid to form Sodium gluconate instead of the desired Zinc gluconate. It is important that the order of addition be followed, otherwise the in situ reaction of Gluconic acid and Zinc oxide may occur very slowly over several hours or not occur at all.

The following Example provides another in situ method for introducing the components of zinc gluconate to these automatic warewash detergent formulations. In this instance zinc and gluconate ions are provided by the sodium gluconate and zinc sulfate compounds.

EXAMPLE 11

| Material | %/wt. |
|---|---|
| Deionized $H_2O$ | 16.93 |
| Sodium gluconate | 2.88 |
| Zinc sulfate.$H_2O$ | 1.19 |
| Trisodium salt of NTA (40%) | 68.50 |
| Dequest 2010 | 1.50 |
| Potassium Hydroxide, Flake (90%) | 5.00 |
| Sodium Hydroxide, Anhydrous | 4.00 |
| | 100.00 |

The same procedures are followed as set forth in Example 10 in combining and mixing the materials.

While the in situ preparation of zinc gluconate has been described in Example 10 from the reaction of gluconic acid and zinc oxide and zinc and gluconic ions provided by the addition of sodium gluconate and zinc sulfate in Example 11, zinc gluconate can also be prepared from other sources of gluconic and zinc ions such as the reaction of gluconic acid with zinc hydroxide. Zinc and gluconic ions can be made available from sodium gluconate with zinc chloride, as well as potassium gluconate with zinc sulfate.

The composition of this invention has been demonstrated to provide improved results when employed in a fast cycle commercial (I&I) dishwasher. An additional advantage of formula compatibility-stability is obtained when the zinc containing formulas are employed in conjunction with a dishwasher having a rinse cycle wherein the rinsing agent includes a nonionic surfactant.

What is claimed is:

1. A liquid automatic dishwashing detergent composition comprising:

(a) a chelate;

(b) a base selected from the group consisting of sodium hydroxide, potassium hydroxide, or a mixture thereof; and (c) at least 3% of zinc gluconate; wherein the zinc gluconate is formed in an in situ process step.

2. The composition of claim 1 wherein the zinc gluconate is formed by the reaction of gluconic acid and zinc oxide.

3. A liquid automatic dishwashing detergent composition comprising:

(a) from about 15% to about 75% of a chelate;

(b) from about 5% to about 25% of a base selected from the group consisting of sodium hydroxide, potassium hydroxide, or a mixture thereof, and (c) from about 2% to about 10% of a zinc gluconate; wherein the zinc gluconate is formed in an in situ process step.

4. A method of preparing a liquid automatic dishwashing detergent composition which includes the combining of a chelate, a base selected from the group consisting of sodium hydroxide, potassium hydroxide, or a mixture thereof, and at least 3% of zinc gluconate, wherein the zinc gluconate is formed in situ.

5. The method of claim 4 wherein the zinc gluconate is formed from the reaction of gluconic acid and zinc oxide.

6. A method of preparing a liquid automatic dishwashing detergent composition which includes the combining of from about 15% to about 75% of a chelate, 5% to about 25% of a base selected from the group consisting of sodium hydroxide, potassium hydroxide, or a mixture thereof, and from about 2% to about 10% of a zinc gluconate, wherein the zinc gluconate is formed in an in situ process step.

7. The method of claim 6 wherein the zinc and gluconic ions are provided by the introduction of sodium gluconate and zinc sulfate.

* * * * *